US008279086B2

(12) United States Patent
Liu et al.

(10) Patent No.: US 8,279,086 B2
(45) Date of Patent: Oct. 2, 2012

(54) TRAFFIC FLOW MONITORING FOR INTERSECTIONS WITH SIGNAL CONTROLS

(75) Inventors: Xianghong Liu, Eagan, MN (US); Wenteng Ma, San Leandro, CA (US); Xinkai Wu, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 481 days.

(21) Appl. No.: 12/567,449

(22) Filed: Sep. 25, 2009

(65) Prior Publication Data

US 2010/0079306 A1 Apr. 1, 2010

Related U.S. Application Data

(60) Provisional application No. 61/100,436, filed on Sep. 26, 2008, provisional application No. 61/100,519, filed on Sep. 26, 2008.

(51) Int. Cl.
*G08G 1/08* (2006.01)

(52) U.S. Cl. ..... 340/909; 340/907; 340/917; 340/937

(58) Field of Classification Search ..... 340/907, 340/909, 910, 911, 916, 917, 919, 920, 922, 340/933, 934, 936, 937, 938; 701/117, 118; 703/8; 707/999.102, 999.104
See application file for complete search history.

(56) References Cited

U.S. PATENT DOCUMENTS 4,370,718 A * 1/1983 Chasek ..... 701/117
5,801,943 A * 9/1998 Nasburg ..... 701/117
6,111,523 A * 8/2000 Mee ..... 340/937
6,188,329 B1 * 2/2001 Glier et al. ..... 1/1
6,281,808 B1 * 8/2001 Glier et al. ..... 340/933
6,373,402 B1 * 4/2002 Mee ..... 340/937
6,573,929 B1 * 6/2003 Glier et al. ..... 348/149
6,617,981 B2 * 9/2003 Basinger ..... 340/909
6,647,361 B1 * 11/2003 Laird et al. ..... 703/8
6,754,663 B1 * 6/2004 Small et al. ..... 1/1
6,950,789 B2 * 9/2005 Laird et al. ..... 703/8

OTHER PUBLICATIONS

Balke, K., Charara, H., Parker, R., Development of a Traffic Signal Performance Measurement System (TSPMS), 2005, Publication FHWA/TX-05/0-4422-2, Federal Highway Administration, US Department of Transportation.

Chen, C., Freeway Performance Measurement System (PeMS), 2002, Ph.D. Dissertation, University of California, Berkeley.

(Continued)

*Primary Examiner* — Van T. Trieu
(74) *Attorney, Agent, or Firm* — Westman, Champlin & Kelly, P.A.; Theodore M. Magee

(57) ABSTRACT

A method and system are provided for determining travel time through intersections by assigning an initial position for a virtual probe in the intersection and updating the position and velocity for the virtual probe such that the position and velocity of the virtual probe are determined multiple times from a time when the virtual probe is at an initial position until the time when the updated position of the virtual probe is past a stop line at the intersection. Updating the position and velocity of the virtual probe involves retrieving vehicle detection data and traffic control signal data to determine a distance from the virtual probe to the closer of a stop line and a vehicle in a queue in front of the virtual probe. The length of the queue is determined using the intersection of two shockwaves.

41 Claims, 10 Drawing Sheets

OTHER PUBLICATIONS

Chen, C., Petty, K., Skabardonis, A., Varaiya, P., Jia, Z., Freeway performance measurement system: mining loop detector data, In: Transportation Research Board, 80th Annual Meeting, Jan. 2001, Washington, DC, pp. 96-102 (also, Transportation Research Record No. 1748).
Cheu, R.L., Lee, D.-H.,Xie, C., An arterial speed estimation model fusing data from stationary and mobile sensors, In: Proceedings of the IEEE Intelligent Transportation Systems Conference, Oakland, CA, 2001, pp. 573-578.
Dailey, D.J., Cathey, F.W., AVL-Equipped Vehicles as Traffic Prove Sensors, Final Report, 2002, Publication WA-RD 534.1, Washington State Transportation Center, University of Washington.
Frechette, L.A., Khan, A.M., Bayesian regression-based urban traffic models, Transportation Research Record 1644, 1998, pp. 157-165.
Geroliminis, N., Skabardonis, A., Real-time vehicle re-identification and performance measure on signalized arterials, In: Proceedings of the Ninth International IEEE Conference on Intelligent Transportation System, 2006, Toronto, Canada.
Liu, H., Ma, W., Arterial travel time estimation using event-based traffic data from signalized intersections, In: Paper Compendium of the 86th Transportation Research Board Annual Meeting, 2007, Washington, DC.
Liu, H., Ma, W., A real-time performance measurement system for arterial traffic signals, In: Paper Compendium of the 87th Transportation Research Board Annual Meeting, 2008, Washington, DC.
Mueck, J., Using Detectors Near the Stop-line to Estimate Traffic Flows, Traffic Engineering and Control, Dec. 2002, pp. 429-434.
Skabardonis, A., Geroliminis, N., Real-time estimation of travel times along signalized arterials, In: Proceedings of 16th International Symposium of Transportation and Traffic Theory (ISTTT), 2005, Maryland, USA.
Smaglik, E.J., Sharma, A., Bullock, D.M., Even based data collection for generation actuated controller performance measures, In: Paper Compendium of the 86th Transportation Research Board Annual Meeting, 2007, Washington, DC.
Stephanopoulos, G., Michalopoulos, P.G., Modeling and analysis of traffic queue dynamics at signalized intersections, Transportation Research Part A 13, 295-307, 1979.
Takaba, S., Morita, T., Hada, T., Usami, T., Yamaguchi, M., Estimation and measurement of travel time by vehicle detectors and license plate readers, In: Proceedings of the Vehicle Navigation and Information Systems Conference, 1991, vol. 1, pp. 257-267.
Turner, S., Eisele, W.L., Benz, R.J., Holdener, D.J., Travel Time Data Collection Handbook, Final Report, 1998, Publication FHWA-PL-98-035, Research Report 07470-1F, Federal Highway Administration, US Department of Transportation.
Yin, Y.F., Li, M., Skabardonis, A., Offline offset refiner for coordinated actuated signal control systems, Journal of Transportation Engineering 133 (7), 2007, pp. 423-432.
Zhang, M.H., Link-journey-speed model for arterial traffic, Transportation Research Record 1676, 1999, pp. 109-115.
Akcelik, R., A Queue Model for HCM 2000, ARRB Transportation Research Ltd, 1999, Vermont South, Australia.
Catling, I., A time dependent approach to junction delays, Traffic and Engineering and Control 18, 1977, pp. 520-526.
Chang, T.H., Lin, J.T., Optimal signal timing for an oversaturated intersection, Transportation Research 2000, Part B 34 (6), pp. 471-491.
Cronje, W.B., Analysis of existing formulas for delay, overflow, and stops, In: Transportation of Research Record 905, TRB, National Research Council, 1983, pp. 93-95, Washington, DC.
Cronje, W.B., Derivation of equations for queue length, stops and delay for fixed-time traffic signals, In: Transportation Research Record 905, TRB, National Research Council, 1983, pp. 93-95, Washington, DC.
Gazis, D.C., Optimal control of a system of oversaturated intersection,Operations Research 12, 1964, pp. 815-831.
Green, D.H., Control of oversaturated intersections, Operational Research Quarterly 18 (2), 1968, pp. 161-173.
Lighthill, M.J., Whitham, G.B., On kinematic waves I Flood movement in long rivers. II A theory of traffic flow on long crowded roads, Proceedings of Royal Society (London) A229, 1955, pp. 281-345.
Liu, H., Ma, W., A virtual probe approach for time-dependent arterial travel time estimation, Transportation Research, 2009, Part C 17 (1), pp. 11-26.
Luyanda, F., Gettman, D., Head, L., Shelby, S., Bullock, D., Mirchandani, P., ACS-Lite algorithmic architecture applying adaptive control system technology to closed-loop traffic signal control systems, 2003, TRR No. 1856 Paper No. 03-2962.
May Jr., A.D., Traffic flow theory—the traffic engineers challenge, Proceedings of the Institute of Traffic Engineering, 1975, pp. 290-303.
Michalopolulos, P., Stephanopoulos, G., Oversaturated signal system with queue length constraints: single intersection, Transportation Research 11, 1977, pp. 413-422.
Michalopoulos, P., Stephanopoulos, G., Oversaturated signal system with queue length constraints: systems of intersections, Transportation Research 11, 1977, pp. 423-428.
Michalopolulos, P., Stephanopoulos, G., An application of shock wave theory to traffic signal control, Transportation Research, 1981, Part B 15, pp. 31-51.
Mirchandani, P.B., Zou, N., Queuing models for analysis of traffic adaptive signal control, IEEE Transactions on Intelligent Transportation Systems 8 (1), 2007.
Newell, G.F., Approximation methods for queues with application to the fixed-cycle traffic light, SIAM Review 7, 1965.
Richards, P.J., Shock waves on the highway, Operations Research 4, 1956, pp. 42-51, MathSciNet Highway Capacity Manual, 2000, TRB, National Research Council, Washington, DC.
Sharma, A., Bullock, D.M., Bonneson, J., Input-output and hybrid techniques for real-time prediction of delay and maximum queue length at a signalized intersection, Transportation Research Record, 2007, #2035, pp. 88-96, TRB, National Research Council, Washington, DC.
Skabardonis, A., Geroliminis, N., Real-time Monitoring and Control on Signalized Arterials, Journal of Intelligent Transportation Systems, 2008, 12 92), pp. 64-74.
Strong, D.W., Nagui, M.R., Ken, C., New calculation method for existing and extended HCM delay estimation procedure, Proceedings of the 85th annual meeting of the Transportation Research Board, 2006, Paper #06-0106, Washington, DC.
Vigos, G., Papageorgiou, M., Wang, Y., Real-time estimation of vehicle-count within signalized links, Transportation Research, 2008, Part C 16(1), pp. 18-35.
Turner, S., Lomas, T.J., Levinson, H.S., Measuring and estimating congestion using travel time-based procedures, Transportation Research Record 1564, 1996, pp. 11-19.
Muck, J., Using detectors near the stop-line to estimate traffic flows, Traffic Engineering and Control 43, 2002, pp. 429-434.
Robertson, D.I., Transyt: A traffic Network Study Tool. 1969, Road Research Laboratory, Laboratory Report LR 253, Crowthorne.

* cited by examiner

TRAFFIC FLOW MONITORING FOR INTERSECTIONS WITH SIGNAL CONTROLS

REFERENCE TO RELATED APPLICATIONS

This application claims priority benefit of U.S. Provisional Application 61/100,436 filed on Sep. 26, 2008 and claims priority benefit of U.S. Provisional Application 61/100,519 filed on Sep. 26, 2008.

BACKGROUND

In urban settings, it is common to have major roadways with multiple intersections that are each controlled by a traffic control signal. Modeling the flow of traffic on such roadways is complicated due to the deceleration and acceleration associated with stopping at each traffic control signal and the adverse legacy effects of queues of vehicles that form at red lights. As a result, estimating travel times along urban roadways with intersections is difficult.

The discussion above is merely provided for general background information and is not intended to be used as an aid in determining the scope of the claimed subject matter.

SUMMARY

A method and system are provided for determining travel time through intersections by assigning an initial position for a virtual probe at the intersection and updating the position and velocity for the virtual probe at uniform time intervals such that the position and velocity of the virtual probe are determined multiple times from a time when the virtual probe is at an initial position until the time when the updated position of the virtual probe is past a stop line at the intersection. Updating the position and velocity of the virtual probe involves retrieving vehicle detection data and traffic control signal data to determine a distance from the virtual probe to the closer of a stop line and a vehicle in a queue in front of the virtual probe. Based on this information, a processor determines whether to change the current velocity of the virtual probe.

A method and system are also provided for determining the length of a queue of vehicles at an intersection when the length of the queue is longer than a distance from a detector to a stop line at the intersection. The length of the queue is determined by determining a velocity of a departure shock wave that moves toward the stop line and by determining a discharge shock wave that starts at the stop line and passes through the queue of vehicles to the rear.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
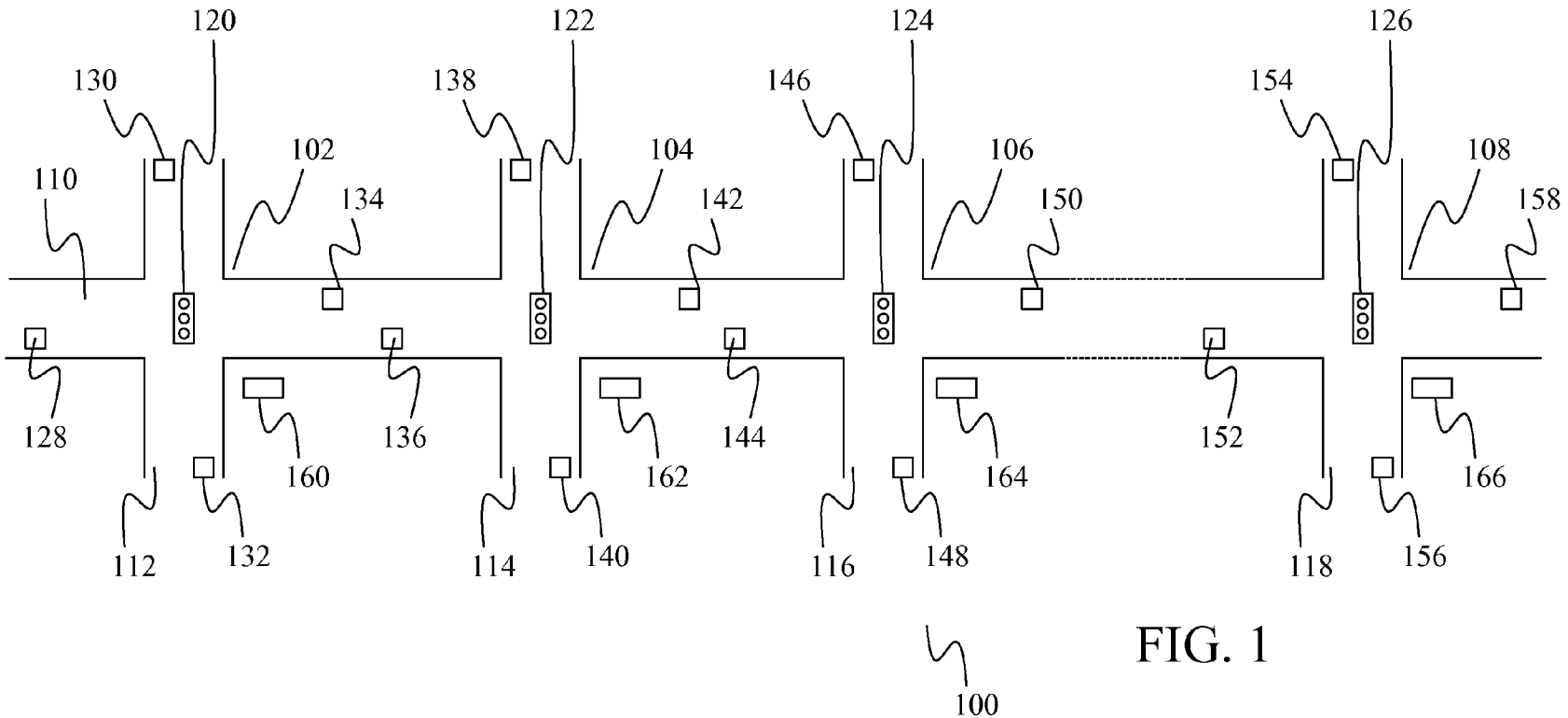
FIG. 1 is a top view of a corridor of intersections.

FIG. 1 provides a diagram of a corridor 100 consisting of a roadway 110 that intersects with roadways 112, 114, 116, and 118 at respective intersections 102, 104, 106, and 108. Intersections 102, 104, 106 and 108 are each controlled by respective traffic control signals 120, 122, 124 and 126. Each traffic control signal controls the flow of traffic through its respective intersection using colored lights that change from green to yellow to red and back to green again.

Control signals 120, 122, 124 and 126 are controlled by respective controllers 160, 162, 164 and 166, which are typically located in cabinets near the intersection. Controllers 160, 162, 164 and 166 activate their respective control signals based on sensor signals provided by detectors located along the roadways. Each detector senses when a vehicle enters and exits the sensing field of that detector. The sensing field or sensing position of the detectors is either at the stop line of the intersection or before the stop line of the intersection. Detectors with sensing fields before the stop line are referred to as advance detectors while detectors with sensing fields at the stop line are referred to as stop-bar detectors. Different combinations of detectors can be installed for each direction of approach to an intersection. Some of the approaches can have both an advance detector and a stop-bar detector, some may have only an advance detector, and some may have only a stop-bar detector.

In FIG. 1, for intersection 102, advance detectors 128, 130, 132 and 134 are provided; for intersection 104, advance detectors 136, 138, 140 and 142 are provided; for intersection 106 advance detectors 144, 146, 148 and 150 are provided and for intersection 108, advance detectors 152, 154, 156 and 158 are provided.

Figure 2:
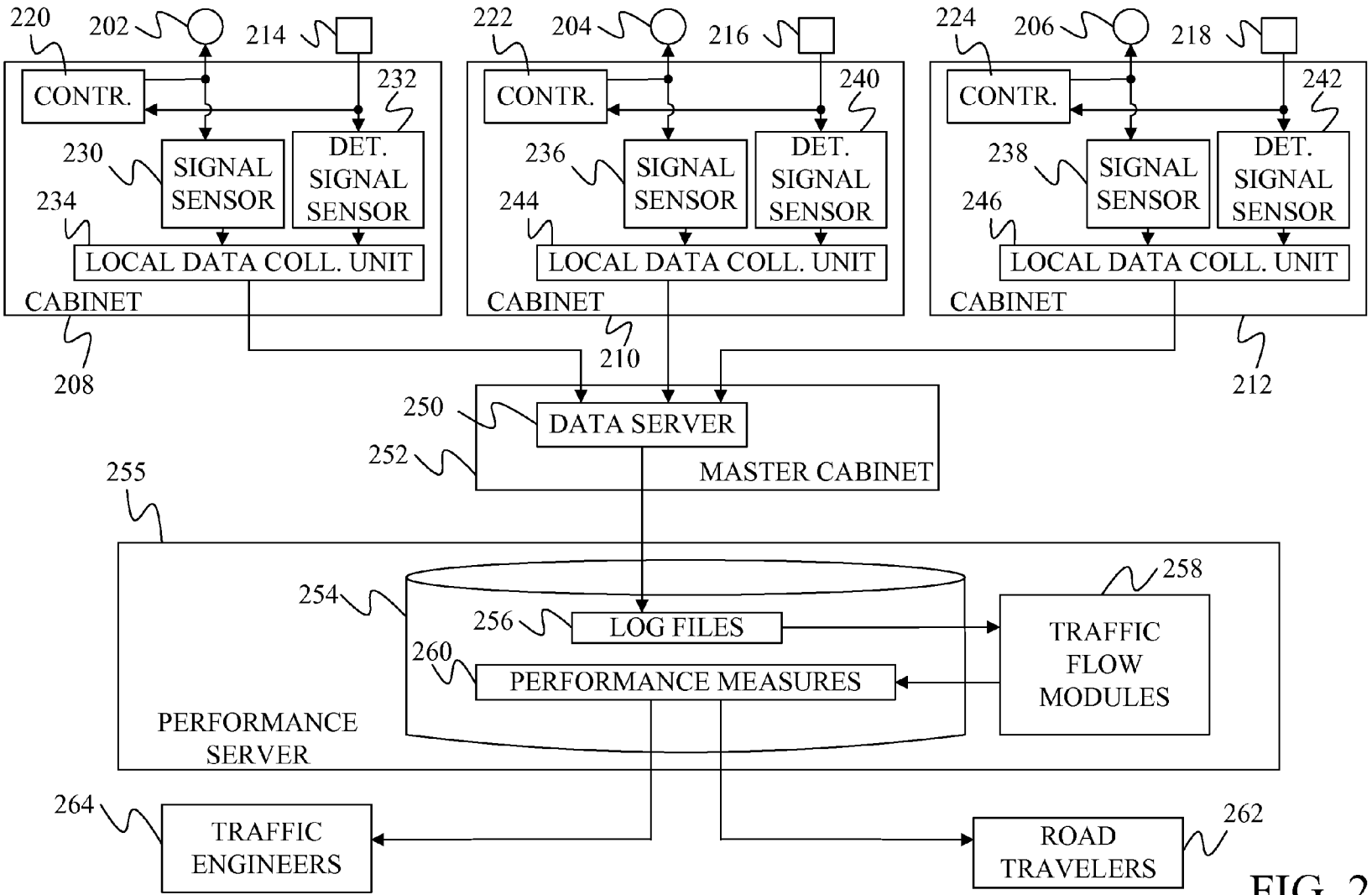
FIG. 2 is a block diagram of a system for monitoring traffic.

FIG. 2 provides a block diagram of an architecture for a traffic monitoring system. In FIG. 2, traffic control signals 202, 204, and 206 receive control signals along electrical conductors from control cabinets 208, 210 and 212, respectively. In addition, detectors 214, 216 and 218 provide electrical sensing signals along electrical conductors that pass into control cabinets 208, 210 and 212, respectively. Within cabinets 208, 210 and 212, respective controllers 220, 222 and 224 are provided. Controller 220 is connected to traffic control signal 202 and detectors 214; controller 222 is connected to traffic control signal 204 and detectors 216; and controller 224 is connected to traffic control signal 206 and detectors 218. The connections between the controllers and the respective traffic control signals are a collection of electrical conductors where each conductor controls a separate set of lights on the traffic control signal. Similarly, the controller is connected to each detector through a separate conductor. Thus, although only a single conduction line is shown in FIG. 2 for the traffic control signals and the detectors, those skilled in the art will understand that each line shown represents multiple conductors. By the same token, signals 202, 204 and 206 represent all signals at their respective intersections and detectors 214, 216 and 218 represent all detectors at their respective intersections.

Each conductor between the controller and the traffic control signal is electrically connected to a signal sensor, which senses the control signal applied on that conductor. Similarly, each conductor connected between the controller and a detector is connected to a respective detector signal sensor, which detects the signal created by the detector on the conductor. For example, in cabinet 208, traffic control signal sensor 230 and detector signal sensor 232 are provided. Traffic control signal sensor 230 provides signals indicative of changes in the control signals provided by controller 220 to traffic control signal 202. The signals from traffic control signal sensor 230 are received by a local data collection unit 234, which uses the signals from traffic control signal sensor 230 to record the time at which certain traffic control signal events occur such as when the signal along the major roadway turns from red to green.

Local data collection unit 234 also receives a signal from detector signal sensor 232 that indicates when a detector senses a vehicle entering the detector's sensing area and when a vehicle exits the detector's sensing area. Local data collection unit 234 applies a time stamp to each such vehicle-detector actuation event. In some embodiments, local data collection unit 234 is further able to compute a time between vehicles known as vacancy time as well as computing a time period between when a vehicle first enters the detector's sensing area until the time when the vehicle exits the detector's sensing area, known as occupancy time. Cabinets 210 and 212 have similar traffic control signal sensors 236 and 238, similar detector signal sensors 240 and 242 and similar local data collection units 244 and 246.

Local data collection units 234, 244 and 246 provide their control signal data and detector data to a data server 250 located in a master cabinet 252 over respective serial port communication channel. Data server 250 collects the data from the local data collection units and communicates the data to a database 254 on a performance server 255 through a high-speed communication channel, for example a DSL communication channel. The data from data server 250 is stored as daily log files 256 in database 254.

Performance server 255 is a computing device that includes one or more processing units, a system memory and a system bus that couples the system memory to the processing units. System memory includes read only memory (ROM) and random access memory (RAM). A basic input/output system (BIOS), containing the basic routines that help to transfer information between elements within the computer is stored in ROM.

Other appropriate computer systems include handheld devices, multi-processor systems, various consumer electronic devices, mainframe computers, and the like. Those skilled in the art will also appreciate that embodiments can also be applied within computer systems wherein tasks are performed by remote processing devices that are linked through a communications network (e.g., communication utilizing Internet or web-based software systems). For example, program modules may be located in either local or remote memory storage devices or simultaneously in both local and remote memory storage devices. Similarly, any storage of data associated with embodiments of the present invention may be accomplished utilizing either local or remote storage devices, or simultaneously utilizing both local and remote storage devices.

The computer of server 255 can further include a hard disc drive, an external memory device, and/or an optical disc drive. External memory device can include an external disc drive or solid state memory that may be attached to the computer through an interface such as a Universal Serial Bus interface, which is connected to a system bus. Optical disc drive can illustratively be utilized for reading data from (or writing data to) optical media, such as a CD-ROM disc. The drives, internal memory devices and external memory devices and their associated computer-readable media provide nonvolatile storage for the personal computer on which computer-executable instructions and computer-readable data structures may be stored. Other types of media that are readable by a computer may also be used in the computing device.

A number of program modules may be stored in the drives and RAM, including an operating system, one or more application programs or program modules and program data. In particular, application programs and program modules can include any applications or program modules that perform the steps discussed below for generating traffic performance measures.

In a networked environment, program modules depicted relative to the server 255, or portions thereof, may be stored in a remote memory storage device. In addition, data associated with an application program, such as data stored in a database, may illustratively be stored within a remote memory storage device.

Traffic flow modules 258 stored on computer-readable media in performance server 255 are executed by a processor in performance server 255. Traffic flow modules 258 use the log files 256 to determine performance measures such as travel time through the intersections and through the corridor and queue lengths at the intersections. These performance measures are stored as performance measure 260 in database 254.

Performance measures 260 are available through network connections, such as an Internet connection, to road travelers 262 and to traffic engineers 264. Thus, road travelers 262 may access performance measures 260 over the Internet and thereby determine current traffic flow parameters such as travel time along the corridor.

Embodiments described herein determine the travel time for traveling along a roadway from a position before an intersection to a position at a stop line at the intersection. To do this, the embodiments utilize a virtual probe, which is a virtual vehicle that is not physically present on the roadway. The virtual probe starts from an initial position and is moved toward the intersection so as to maximize the speed of the virtual probe while ensuring that the virtual probe does not exceed a selected maximum speed for the probe and while ensuring that the virtual probe is able to stop in time to avoid a collision with vehicles in a queue at an intersection and to avoid entering the intersection if the control signal is red.

Figure 3:
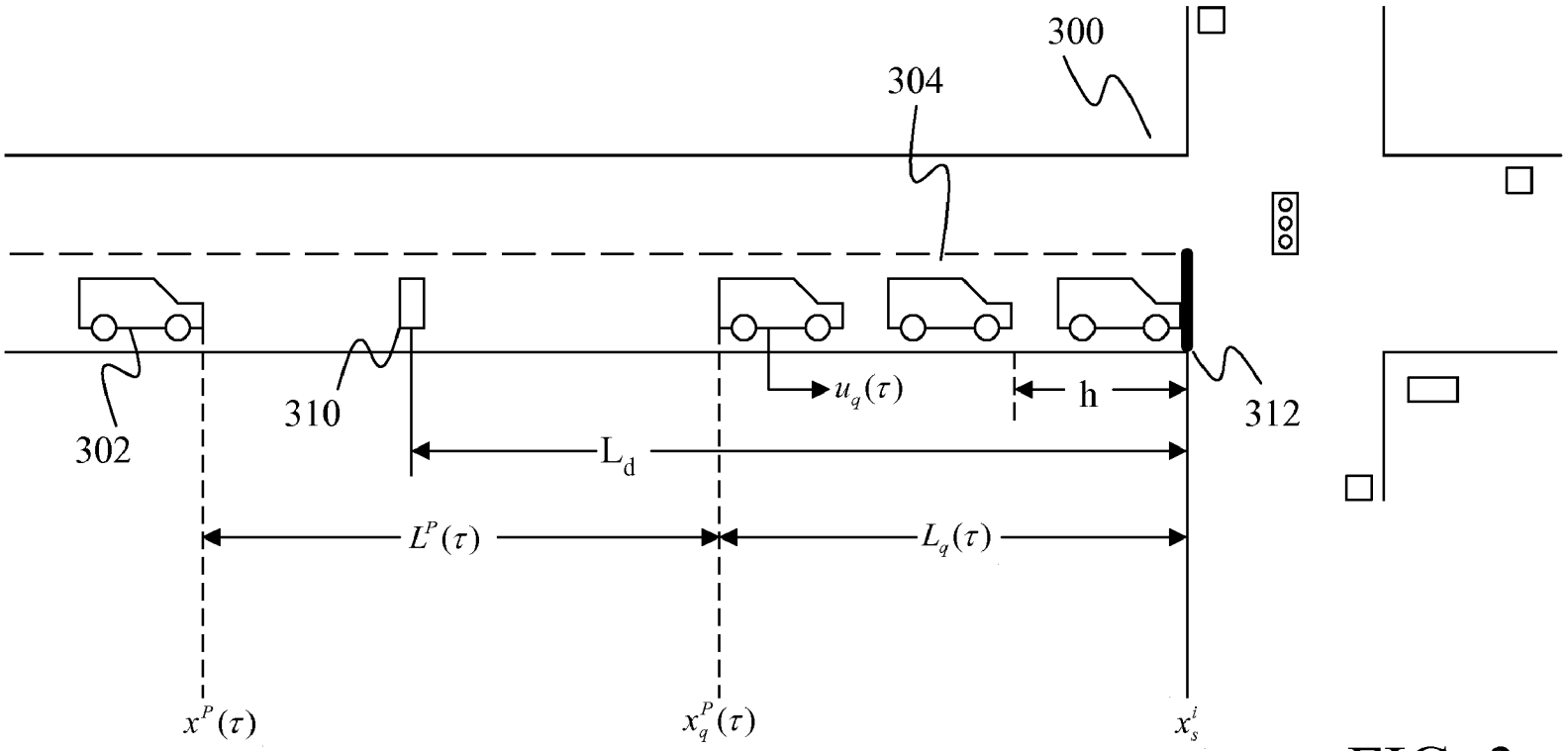
FIG. 3 is a diagram of an intersection.

FIG. 3 provides a diagram of an intersection 300 showing a virtual probe 302 and a queue of vehicles 304 stopped at an intersection 300. At a time point $\tau$, virtual probe 302 is at a position $x^P(\tau)$ and the back of the queue of vehicles in front of the virtual probe is located at a position $x_q^P(\tau)$. The stop line of the intersection is located at a point $x_s^i$. The distance from the end of the queue to the stop line is shown as $L_q(\tau)$ and the distance from the end of the queue to the virtual probe is shown as distance $L^P(\tau)$. The distance from the sensing area 310 of an advance detector to the stop line 312 is shown as distance $L_d$. Within the queue, the distance from the front of one vehicle to the next vehicle is shown as headway h. The last vehicle in the queue moves with a velocity $u_q(\tau)$.

Figure 4:
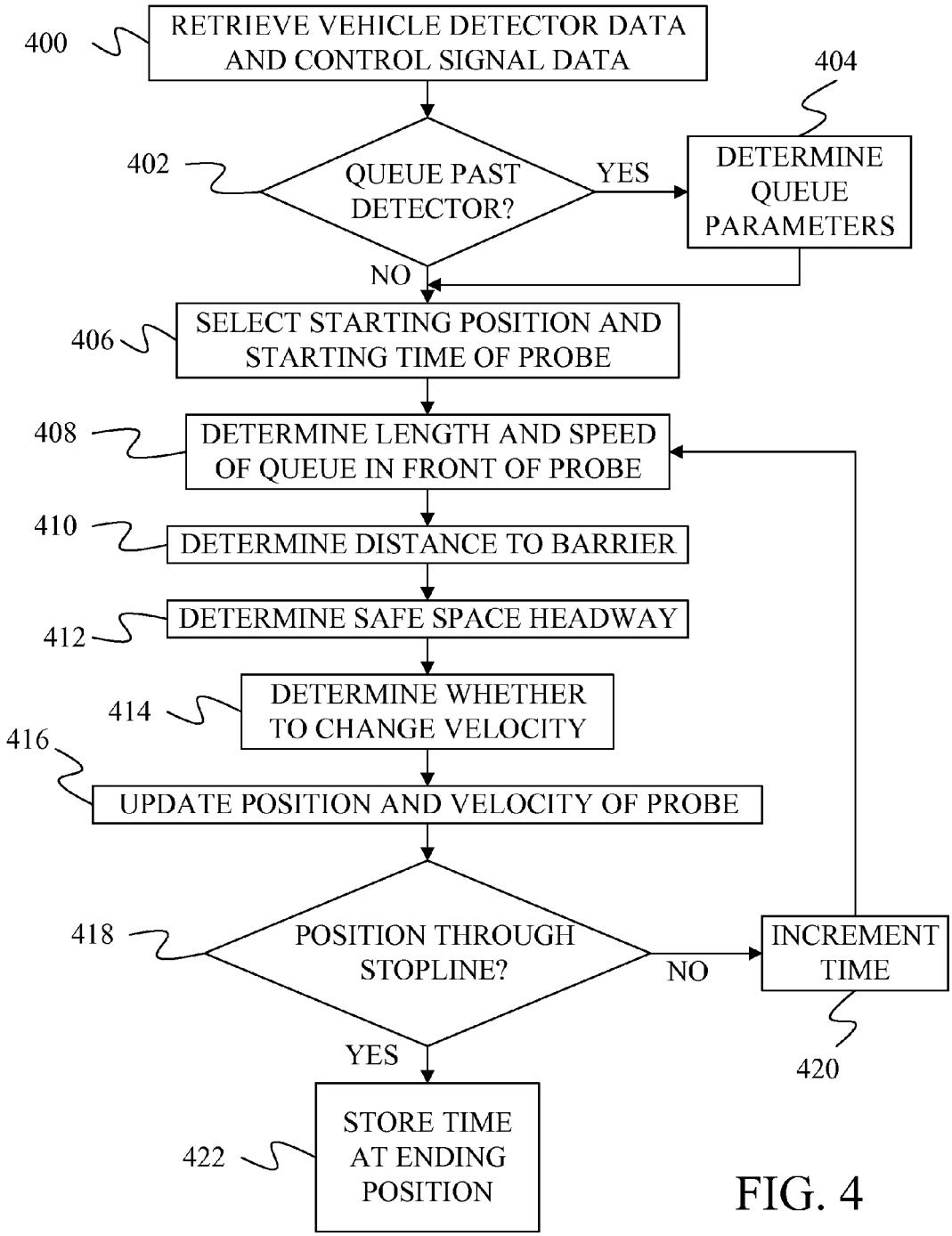
FIG. 4 is a flow diagram for determining virtual probe movements.

FIG. 4 provides a flow diagram of a method for moving a virtual probe through an intersection based on vehicle detector data from the detector and traffic control signal data for the intersection.

In step 400, the vehicle detector data and traffic control signal data for two cycles of the traffic control signal are retrieved. At step 402, the retrieved data is used to determine whether the queue of vehicles at the traffic control signal in the direction of travel of the virtual probe extends past the sensing area of the vehicle detector. This determination can be made by identifying data that indicates a long occupancy time at the sensing area of the detector. Under one embodiment, an occupancy time of 3 seconds is considered long enough to indicate that the queue extends past the sensing area of the detector.

If the queue extends past the sensing area of the detector during the current control signal cycle, parameters for the queue are determined at step 404.

Figure 5:
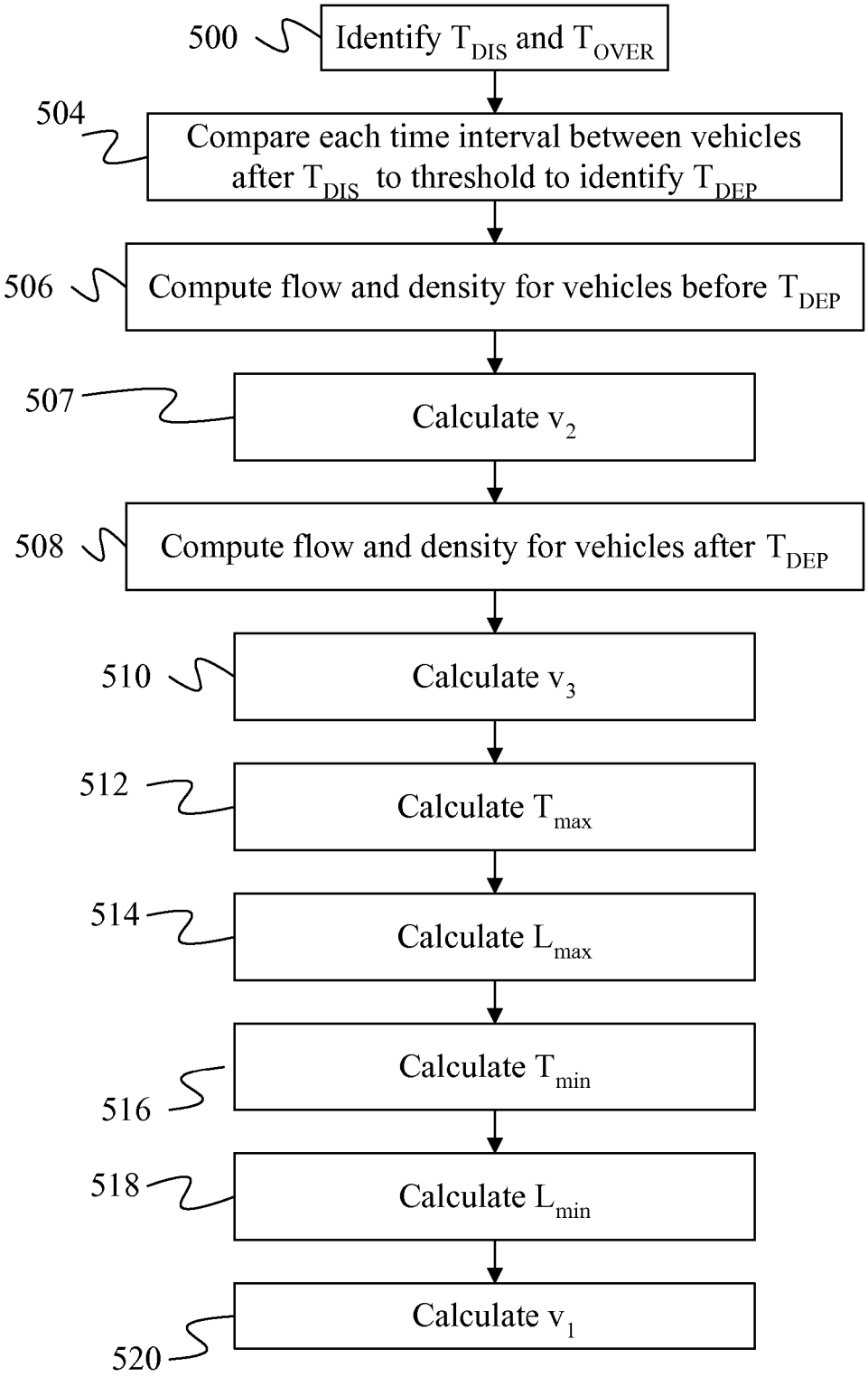
FIG. 5 is a flow diagram for determining initial values for a queue that extends past a detector.
Figure 6:
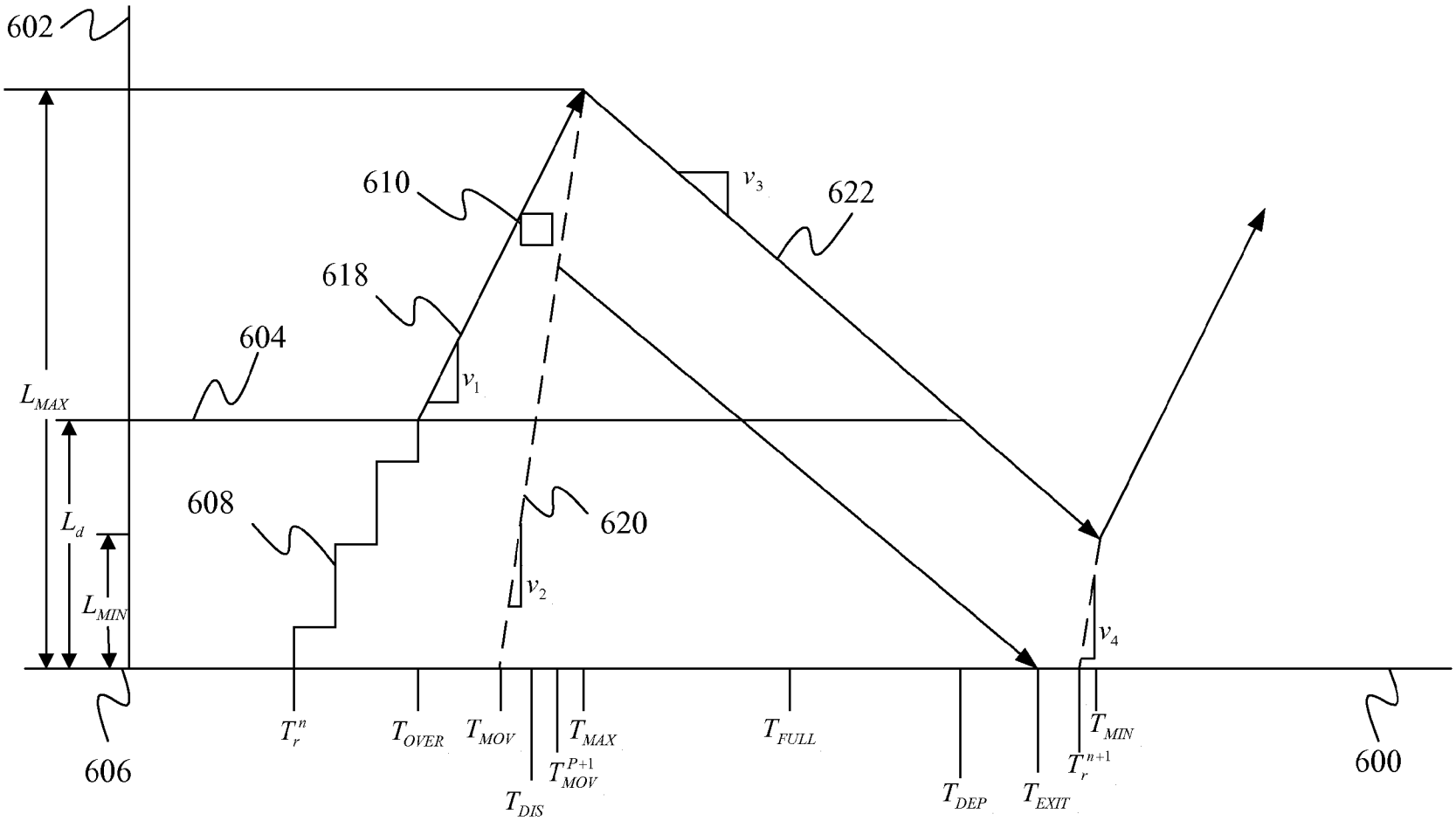
FIG. 6 is a graph showing the development and discharge of a queue that extends past a detector.

FIG. 5 provides a flow diagram of a method of determining the parameters for a queue that extends past a sensing area or sensing position of a detector as represented by step 404 in FIG. 4. FIG. 6 provides a time versus distance diagram showing the development and discharge of a queue that extends past a sensing area or sensing position of a detector. In FIG. 6, time is shown along horizontal axis 600 and distance is shown along vertical axis 602.

In FIG. 6, a sensing area 604 of a detector is positioned a distance $L_d$ from a stop line 606. At a time $T_r^n$, the control signal for the intersection turns red and a queue begins to build behind stop line 606 as indicated by graph line 608. At time point $T_{over}$, the queue reaches the sensing area 604 of the detector and continues to grow at a rate $v_1$ as indicated by line 618. At time point $T_{MOV}$, the control signal has turned green and the first vehicle in the queue has begun to move. At time point $T_{DIS}$, a discharge shockwave, represented by line 620, has passed through the queue and reached the sensing area of the detector. The discharge shockwave represents the motion of a discontinuity in the concentration of vehicles on the roadway caused by vehicles in front of the queue moving away from vehicles that are still stopped in the queue. This discharge shockwave moves with a velocity $v_2$ through the queue of vehicles. At time point $T_{MAX}$, the queue reaches its maximum length when the discharge shockwave reaches the last vehicle added to the queue. Thereafter, the size of the queue begins to decrease at a rate described by a departure shockwave velocity $v_3$ for a departure shockwave that moves from the maximum queue length toward the stop line as represented by line 622. The departure shockwave represents the motion of a discontinuity in the concentration of vehicles on the roadway caused by vehicles discharged from the queue moving relative to vehicles arriving from upstream of the queue. The departure shockwave reaches the detector sensing position 604 at time point $T_{DEP}$. At time point $T_r^{n+1}$ the light turns red again and vehicles begin stopping at the intersection. This action forms a compression shockwave that moves from the stop line with a velocity $v_4$. When the departure shockwave and the compression shockwave meet, the minimum length of the queue, $L_{MIN}$, occurs at a time point $T_{MIN}$.

FIG. 5 provides a flow diagram for identifying time points $T_{OVER}$, $T_{DIS}$, $T_{MS}$, $T_{DEP}$, $T_{MIN}$, the maximum queue length $L_{MAX}$ achieved at time $T_{MAX}$, and the minimum queue length $L_{MIN}$. These values are then used to compute the growth rate $v_1$ of vehicles added to the queue and to determine the number of vehicles that are not discharged at the intersection. The process of FIG. 5 can be used for any position for the sensing area of the detector and thus can be used for both an advance detector and a stop-bar detector.

The process of FIG. 5 begins at step 500 where time points $T_{OVER}$ and $T_{DIS}$ are identified. Time point $T_{OVER}$ is identified by identifying a detector occupancy time that is larger than a threshold, for example 3 seconds. Time point $T_{DIS}$ the time at which the discharge shockwave reaches the detector's sensing position 604. When the shockwave reaches the detector's sensing position, the vehicle located at the detector's sensing position begins to move. Thus, time point $T_{DIS}$ is identified as the time when the occupancy time of the detector drops below 3 seconds after being above 3 seconds.

At step 504, the time intervals between vehicles after $T_{DIS}$ are compared to a threshold to identify $T_{DEP}$. Time point $T_{DEP}$ represents the time when a departure shock wave representing the last vehicle in the queue reaches the detector's sensing position 604. This shockwave appears as a change in the spacing between the vehicles since the vehicles in the queue are spaced closer together than the vehicles arriving behind the queue. Thus, comparing the time gap between vehicles to a threshold, it is possible to identify when the time gap has increased to a point that indicates that the departure shockwave has reached the detector's sensing position 604. Under one embodiment, the threshold interval between vehicles for the departure shockwave is 2.5 seconds.

At step 506, a vehicle flow and vehicle density are computed for a group of vehicles that pass through the detector's sensing area between time $T_{DIS}$ and time $T_{DEP}$ using:

$$u_i = \frac{L_e}{t_{o,i}} \quad \text{Eq. 1}$$

$$u_s = \frac{1}{\left(\frac{1}{n}\sum_{i=1}^{n}\frac{1}{u_i}\right)} \quad \text{Eq. 2}$$

$$q = \frac{1}{\left(\frac{1}{n}\sum_{i=1}^{n}(t_{o,i} + t_{g,i})\right)} \quad \text{Eq. 3}$$

$$k = \frac{q}{u_s} \quad \text{Eq. 4}$$

where $t_{o,i}$ and $t_{g,i}$ are the detector occupancy time and the time gap between vehicle i crossing the detector's sensing area and the vehicle in front of vehicle i leaving the detector's sensing area, respectively; $u_i$ is the speed of vehicle i; $L_e$ is the effective vehicle length, which for example may be taken as the sum of the average vehicle length and the detector's sensing area length, n is the number of vehicles passing the detector between time point $T_{DIS}$ and time point $T_{DEP}$, q is the flow rate of the vehicles, $u_s$ is the space mean speed of the vehicles and k is the density of the vehicles.

At step 507 the velocity of the discharge shockwave is computed as:

$$v_2 = \frac{q_m - 0}{k_m - k_j} \quad \text{Eq. 5}$$

where $q_m$ and $k_m$ are the flow rate and density between time $T_{DIS}$ and time $T_{DEP}$, and $k_j$ is the density of vehicles before time $T_{DIS}$, which under one embodiment is 1/h where h is the headway between cars in the queue.

When an advance detector is used and the distance $L_d$ from a stop line to the sensing area of the detector is greater than zero, the velocity of the discharge shockwave may alternatively be computed from $T_{DIS}$ and $T_{MOV}$, where $T_{MOV}$ is the time point at which the first vehicle in the queue begins to move and thus represents the time at which the discharge shockwave starts. $T_{MOV}$ is calculated by adding a small reaction time to the time point when the control signal changes to green. The velocity of the discharge wave is then computed as:

$$v_2 = \frac{L_d}{T_{DIS} - T_{MOV}} \quad \text{EQ. 6}$$

At step 508 the flow rate, q, and density, k, are determined for a set of vehicles just after time point $T_{DEP}$ using equations 2-5, above, where n becomes the number of vehicles after time point $T_{DEP}$.

At step 510, the velocity of the departure shock wave $v_3$ is computed as:

$$v_3 = \frac{q_m - q_a}{k_m - k_a} \quad \text{Eq. 7}$$

where $q_m$ and $k_m$ are the flow rate and density before time point $T_{DEP}$ and $q_a$ and $k_a$ are the flow rate and density after time point $T_{DEP}$ determined at step 508.

At step 512, the maximum length of the queue, $L_{MAX}$, is determined as:

$$L_{MAX} = L_d + \frac{(T_{DEP} - T_{DIS})}{\left(\frac{1}{v_2} + \frac{1}{v_3}\right)} \quad \text{Eq. 8}$$

And at step 514, the time point at which the maximum queue length is achieved is computed as:

$$T_{MAX} = T_{DIS} + \frac{(L_{MAX} - L_d)}{v_2} \quad \text{Eq. 9}$$

At step 516, the number of vehicles that are not discharged by the queue, which is represented by the minimum size of the queue, $L_{MIN}$, is computed as:

$$L_{MIN} = \frac{\left(\frac{L_{MAX}}{v_3} + T_{MAX} - T_r^{n+1}\right)}{\left(\frac{1}{v_3} + \frac{1}{v_4}\right)} \quad \text{Eq. 10}$$

where $T_r^{n+1}$ is the time at which the control signal returns to red and the velocity of the compression shockwave $v_4$ is similar to the velocity of the discharge shockwave $v_2$ such that $v_4 = v_2$ in equation 10.

At step 518, the time point at which the minimum queue length occurs, $T_{MIN}$, is determined as:

$$T_{MIN} = T_r^{n+1} + \frac{(L_{MIN})}{v_4} \quad \text{Eq. 11}$$

At step 520, the growth rate of the queue, $v_1$, is computed as:

$$v_1 = \frac{(L_{MAX} - L_d)}{T_{MAX} - T_{OVER}} \quad \text{Eq. 12}$$

In an alternative embodiment of FIG. 5, the maximum length of the queue is determined before determining the velocity of the departure shockwave. The equations for determining $L_{MAX}$, $T_{MAX}$, and $v_3$ under such an embodiment are:

$$L_{MAX} = \frac{n}{k_j} + L_d \quad \text{Eq. 13}$$

$$T_{MAX} = T_{MOV} + \frac{L_{MAX}}{v_2} \quad \text{Eq. 14}$$

$$v_3 = \frac{L_{MAX} - L_d}{T_{DEP} - T_{MAX}} \quad \text{Eq. 15}$$

where n is the number of vehicles passing through the detector's sensing area between time point $T_r^n$ and time point $T_{DEP}$, and $k_j$ is the density of vehicles in the queue.

In a further alternative embodiment, $L_{MAX}$, $T_{MAX}$, and $v_3$ are computed as:

$$L_{MAX} = L_d + v_2 t \quad \text{Eq. 16}$$

$$T_{MAX} = T_{DIS} + t \quad \text{Eq. 17}$$

$$v_3(\tau) = \begin{cases} a(\tau - T_{MAX}) & \text{if } (\tau - T_{MAX}) \le \frac{u_f}{a} \\ u_f & \text{otherwise} \end{cases} \quad \text{Eq. 18}$$

where $$\begin{cases} \frac{1}{2}a\left(\frac{u_f}{a}\right)^2 + u_f\left(T_{DEP} - T_{DIS} - t - \frac{u_f}{a}\right) = v_2 t & \text{if } (T_{DEP} - T_{DIS} - t) \le \frac{u_f}{a} \\ \frac{1}{2}a(T_{DEP} - T_{DIS} - t)^2 = v_2^t & \text{otherwise} \end{cases} \quad \text{Eq. 19}$$

$u_f$ is a maximum velocity for other vehicles on the roadway, a is an acceleration rate, which under one embodiment is selected as 3.5 feet/s2, and $\tau$ is a current time point.

Returning to FIG. 4, if the queue is not past the sensing area of the detector at step 402 or after determining the queue parameters at step 404, a starting position and starting time are selected for the probe at step 406. Typically, the starting position for the probe will be just past the stop line of the previous intersection.

At step 408, the length of the queue and the speed of the last vehicle in the queue in front of the probe are determined.

Figure 8:
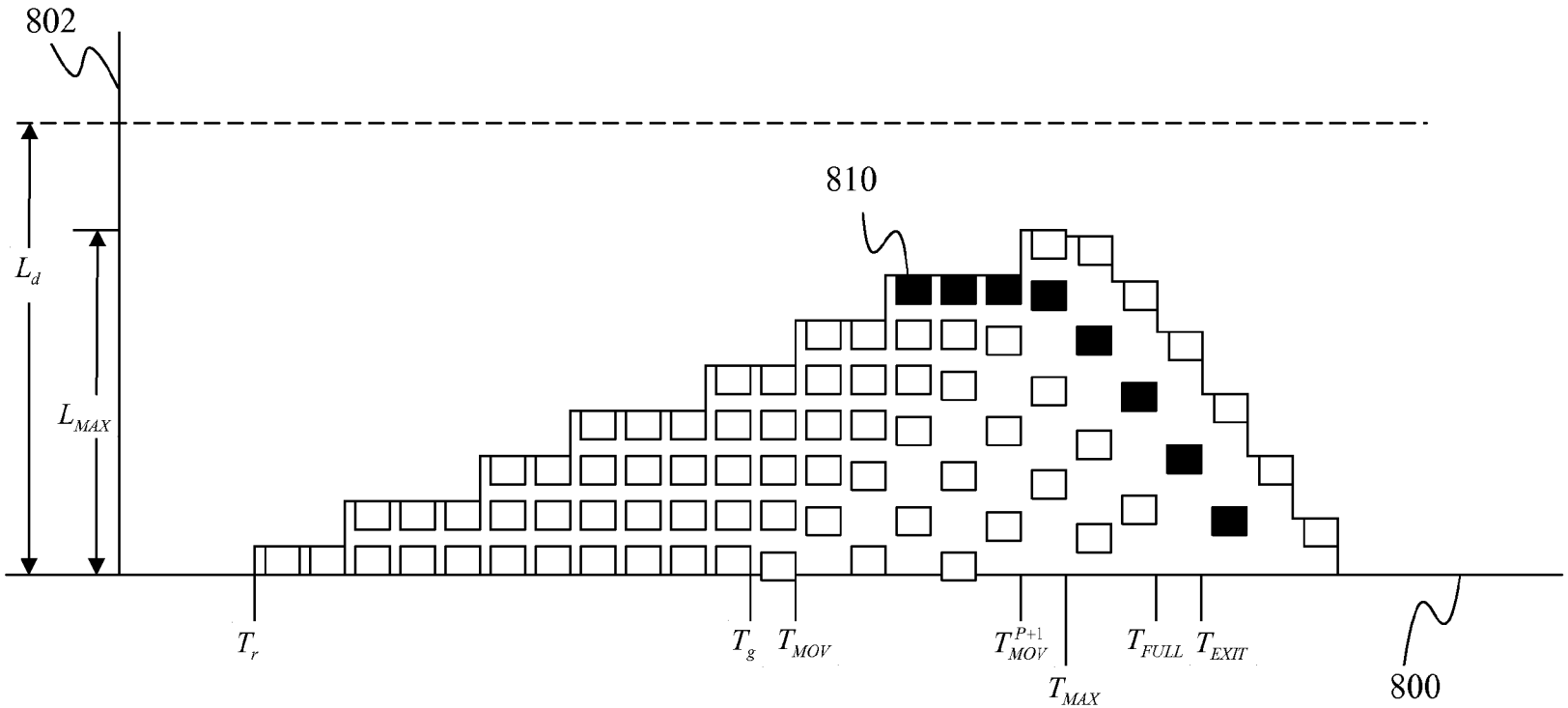
FIG. 8 is a graph showing the development and discharge of a queue that does not extend to an advance detector.

The length of the queue and the speed of the queue in front of the probe are dependent on the formation and the discharge of the queue as well as the virtual probe's location within the queue. FIGS. 6 and 8 provide graphs of time and distance showing the length of the queue at various time points. In FIG. 6, time is shown along horizontal axis 600 and distance is shown along vertical axis 602. In FIG. 8 time is shown along horizontal axis 800 and distance is shown along vertical axis 802. For queues that extend past the detector's sensing area, as shown in FIG. 6 and for queues that do not extend past the detector's sensing area as shown in FIG. 8, the length of the queue and the speed of the last vehicle in the queue before the probe is dependent on the time at which the control signal turned red, $T_r$, the time at which the vehicle in front of the probe begins to move, $T_{MOV}^{P+1}$, the time at which the vehicle in front of the probe reaches full speed, $T_{FULL}$, and the time at which the vehicle in front of the probe reaches the stop line, $T_{EXIT}$. In FIG. 6, the location of the probe is indicated by virtual probe marker 610 and in FIG. 8 by virtual probe marker 810. In FIG. 8 individual vehicles are shown as blocks and virtual probe maker 810 is shown as a shaded block.

Figure 7:
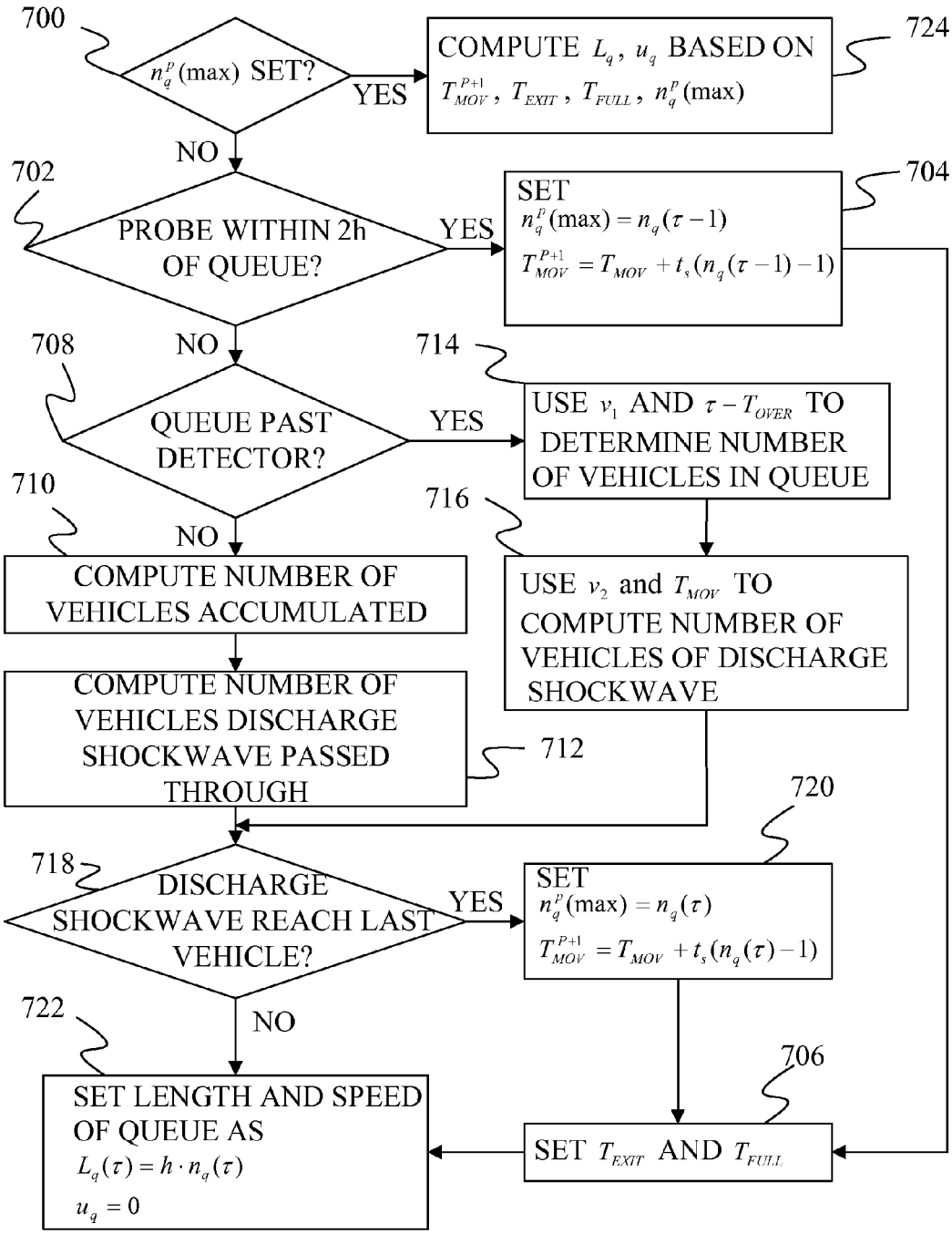
FIG. 7 is a flow diagram for determining the length of a queue in front of the virtual probe and the speed of the last vehicle in front of the virtual probe.

FIG. 7 determines the length of the queue in front of the probe and the speed of the vehicle in the queue in front of the probe by first determining whether the maximum number of vehicles that can be in the queue before the probe has been determined. If the maximum number of vehicles that can be before the probe has not been determined at step 700, the processor continues at step 702 where it determines whether the virtual probe is within a distance **2*h* of the end of the queue, where h is the average spacing between the fronts of vehicles in the queue. If the probe is within 2 h of the end of the queue, no further vehicles can be added to the queue between the probe and the end of the queue. As such, at step 704**, the maximum number of vehicles that can be in the queue before the virtual probe, $n_q^P(\max)$, is set equal to the number of vehicles in the queue at the previous time interval $n_q(\tau-1)$. In addition, the time point $T_{MOV}^{P+1}$, representing the time at which the vehicle in front of the virtual probe begins to move, is calculated as:

$$T_{MOV}^{P+1}=T_{MOV}+t_s(n_q(\tau-1)-1) \quad \text{Eq. 20}$$

where $T_{MOV}$ is the time at which the first vehicle in the queue begins to move, $t_s$ is a uniform starting time difference between two adjacent queued vehicles, which in one embodiment is 0.5 seconds, and $n_q(\tau-1)$ is the number of vehicles in the queue calculated at the previous time interval $(\tau-1)$.

At step 706, time points $T_{EXIT}$ and $T_{FULL}$ are calculated. To determine these time points, the processor first determines whether the vehicle in front of the virtual probe will reach a desired velocity $u_f$ before the stop line of the intersection. This can be determined by determining if the following equation is true:

$$h \cdot n_q^P(\max) > \frac{u_f^2}{2\gamma_a} \quad \text{Eq. 21}$$

where h is the average distance between the fronts of vehicles in the queue, $n_q^P(\max)$ is the maximum number of vehicles in front of the probe in the queue, $u_f$ is the desired maximum velocity for vehicles along the roadway and $\gamma_a$ is the estimated acceleration of the vehicles in the queue. If equation 21 is true, the vehicle in front of the virtual probe will reach velocity $u_f$ before reaching the stop line. If equation 21 is true, the time point at which the vehicle in front of the virtual probe reaches its full velocity is computed as:

$$T_{FULL} = T_{MOV}^{p+1} + \frac{u_f}{\gamma_a} \quad \text{Eq. 22}$$

where $T_{FULL}$ is the time point at which the vehicle in front of the virtual probe reaches its full velocity. The time point at which the vehicle in front of the virtual probe reaches the stop line then becomes:

$$T_{EXIT} = T_{MOV}^{p+1} + \frac{u_f}{2\gamma_a} + \frac{h \cdot n_q^P(\max)}{u_f} \quad \text{Eq. 23}$$

where $T_{EXIT}$ is the time point at which the vehicle in front of the virtual probe crosses the stop line.

If equation 21 is not true, the vehicle in front of the virtual probe will not reach its full speed before the stop line and the time point at which it will cross the stop line is computed as:

$$T_{EXIT} = T_{MOV}^{p+1} + \sqrt{\frac{2h \cdot n_q^P(\max)}{\gamma_a}} \quad \text{Eq. 24}$$

At step 722, the current length of the queue is set as:

$$L_q(\tau)=h \cdot n_q(\tau) \quad \text{Eq. 25}$$

and the speed of the last vehicle in the queue is set equal to 0.

If at step 702 the probe is not within a distance of 2 h of the last vehicle in the queue, additional vehicles may be added to the queue. At step 708, the processor determines whether the queue currently extends past the sensing area of the detector. If the queue does not currently extend past the sensing area of the detector, the number of vehicles that have accumulated in the queue is determined at step 710 by adding the number of vehicles that have passed the sensing area of the detector up to the current time point $\tau$ to the number of vehicles that did not clear the intersection during the last cycle of the control signal. The number of vehicles that did not clear the intersection is equal to $L_{MIN}/h$ where $L_{MIN}$ is the minimum queue length calculated for the previous signal cycle using equation 10 above and h is the headway between vehicles.

At step 712, a processor determines a number of vehicles that a discharge shockwave has passed through. The discharge shockwave is the motion of a discontinuity created by a movement of vehicles at the front of the queue after the control signal turns green. If the control signal has not yet turned green, none of the vehicles have been discharged. After time point $T_{MOV}$, the number of vehicles discharged by the shock wave may be computed as:

$$n_{DIS} = \text{int}\left(\frac{\tau - T_{MOV}}{t_s}\right) + 1 \quad \text{Eq. 26}$$

where $n_{DIS}$ is the number of vehicles that the discharge shockwave has passed through, and int( )represents the integer portion of the values within the parenthesis.

If the queue does extend past the sensing area of the detector at step 708, the queue growth rate $v_1$ and the difference between the current time $\tau$ and the time at which the queue reached the detector, $T_{OVER}$, are used in step 714 to determine the number of vehicles in the queue as:

$$n_q(\tau) = \text{int}\left(\frac{v_1(\tau - T_{OVER}) + L_d}{h}\right) \quad \text{Eq. 27}$$

At step 716, the number of vehicles that the discharge shockwave has passed through is calculated as:

$$n_{DIS} = \text{int}\left(\frac{v_2(\tau - T_{MOV})}{h}\right) \quad \text{Eq. 28}$$

After steps 712 or 716, the processor determines if the discharge shockwave has reached the last vehicle in the queue by comparing $n_{DIS}$ to $n_q(\tau)$. If $n_{DIS}$, equals $n_q(\tau)$, the end of the queue has begun to move. As such, the number of vehicles in the queue at this time point is the maximum number of vehicles that will be in the queue before the virtual probe. As such, at step 720, $n_q^P(\max)$ is set equal to the current number vehicles in the queue and $T_{MOV}^{P+1}$ is calculated as:

$$T_{MOV}^{P+1} = T_{MOV} + t_s(n_q(\tau) - 1) \quad \text{Eq. 29}$$

The processor then determines $T_{EXIT}$ and $T_{FULL}$ using step 706 above.

If the discharge shock wave has not reached the last vehicle in the queue at step 718 or after step 706, the length of the queue for current time point $\tau$ is computed using equation 15 above and the speed of the last vehicle in the queue is set equal to 0.

If at step 700, the maximum number of vehicles in the queue before the virtual probe has been determined, the process continues at step 724 where the length of the queue and the speed of the last vehicle in the queue are computed based on $T_{MOV}^{P+1}$, $T_{EXIT}$, and $n_q^P(\max)$ as:

$$L_q(\tau) = \begin{cases} h \cdot n_q^P(\max) - \frac{1}{2}\gamma_a\left(\tau - T_{MOV}^{P+1}\right)^2 & \text{for } T_{MOV}^{P+1} < \tau \le T_{EXIT} \\ 0 & \text{for } T_{EXIT} < \tau \end{cases} \quad \text{Eq. 30}$$

$$u_q = \gamma_a\left(\tau - T_{MOV}^{P+1}\right) \quad \text{Eq. 31}$$

where equations 30 and 31 are used when the last vehicle in the queue before the virtual probe will not reach full speed before the stop line of the intersection. When the last vehicle in the queue before the virtual probe will reach full speed before the stop line of the intersection, the length of the queue and the speed of the last vehicle in the queue before the virtual probe are calculated as:

$$L_q(\tau) = \begin{cases} h \cdot n_q^P(\max) - \frac{1}{2}\gamma_a\left(\tau - T_{MOV}^{P+1}\right)^2 & \text{for } T_{MOV}^{P+1} < \tau \le T_{FULL} \\ h \cdot n_q^P(\max) + \frac{1}{2}\gamma_a\left(\tau - T_{MOV}^{P+1}\right)^2 - u_f\left(\tau - T_{MOV}^{P+1}\right) & \text{for } T_{FULL} < \tau \le T_{EXIT} \\ 0 & \text{for } T_{EXIT} < \tau \end{cases} \quad \text{Eq. 32}$$

$$u_q(\tau) = \begin{cases} \gamma_a\left(\tau - T_{MOV}^{P+1}\right) & \text{for } T_{MOV}^{P+1} < \tau \le T_{FULL} \\ u_f & \text{for } T_{FULL} < \tau \le T_{EXIT} \end{cases} \quad \text{Eq. 33}$$

Returning to FIG. 4, after the length of the queue in front of the virtual probe and the speed of the last vehicle in the queue in front of the virtual probe have been determined as step 408, the processor determines a distance to the closest barrier from the virtual probe at step 410. The closest barrier will either be the stop line or the last vehicle in the queue before the virtual probe. The distance to the barrier is then computed as:

$$L^P(\tau) = x_s^i - x^P(\tau) - L_q(\tau) \quad \text{Eq. 34}$$

where $x_s^i$ is the location of the stop line; $x^P(\tau)$ is the location of the virtual probe at the current time point r, and $L_q(\tau)$ is the length of the queue determined at step 408.

At step 410, the processor determines a safe space headway 412, which represents the distance the virtual probe will travel at a constant deceleration rate to a velocity of 0 if the barrier is the stop line or the distance the virtual probe will travel at a constant deceleration rate before reaching the velocity of the last vehicle in the queue as determined in step 408. In particular, the safe space headway, $L_s^P(\tau)$ is calculated as:

$$L_s^P(\tau) = \begin{cases} \frac{(u^P(\tau))^2}{2\gamma_a} & \text{if } L_q(\tau) = 0 \\ \frac{(u^P(\tau) - u_q(\tau))^2}{2\gamma_d} & \text{if } L_q(\tau) > 0 \text{ and } u^P(\tau) > u_q(\tau) \\ 0 & \text{otherwise} \end{cases} \quad \text{Eq. 35}$$

where $u^P(\tau)$ is the velocity of the virtual probe at time $\tau$; $u_q(\tau)$ is the velocity of the last vehicle in the queue at time $\tau$; $\gamma_d$ is the constant deceleration rate; and $L_s^P(\tau)$ is the safe space headway.

Figure 9:
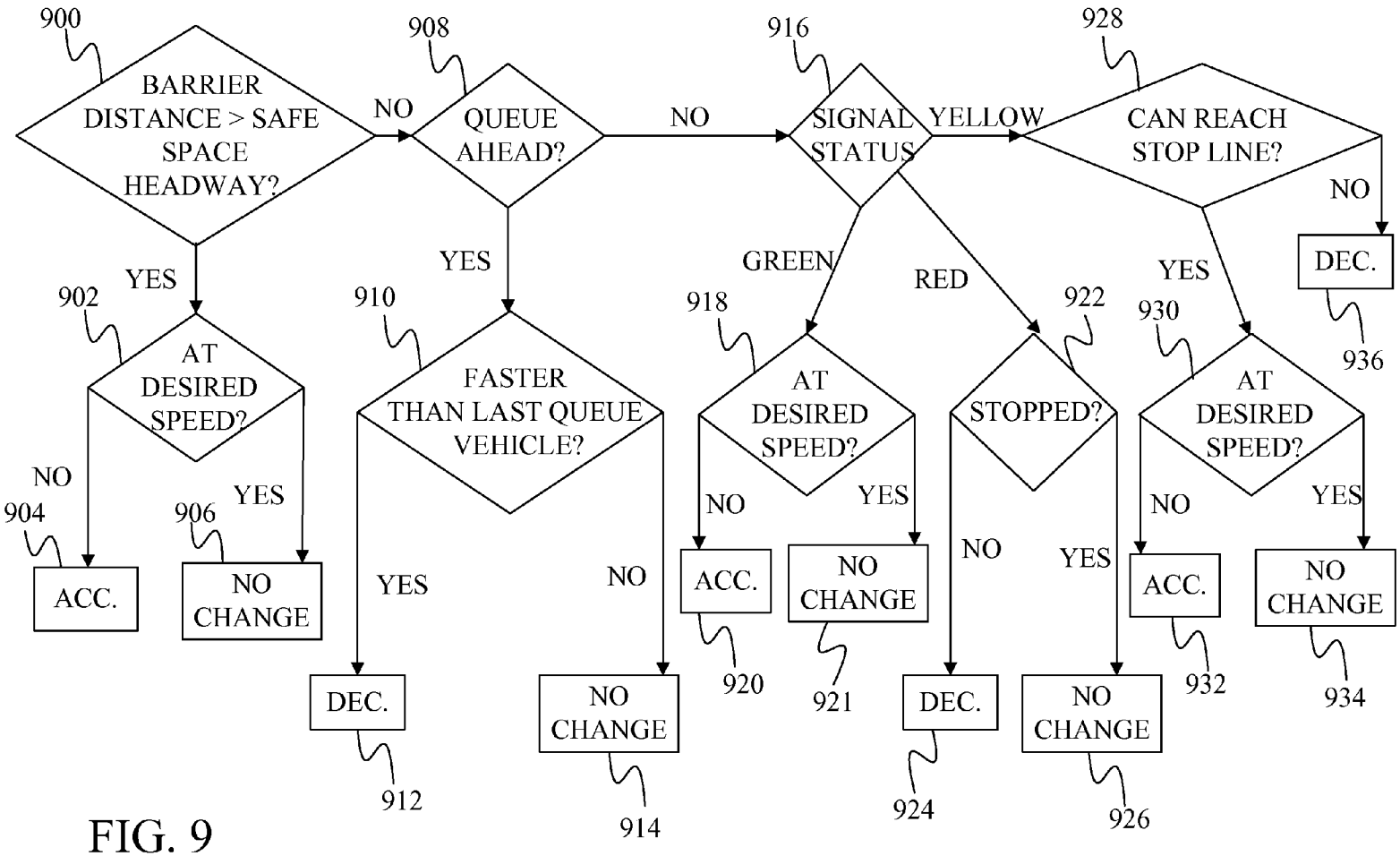
FIG. 9 is a flow diagram for determining whether to the change a velocity of a probe.

At step 414, the processor determines whether to change the velocity of the virtual probe. The method for making this determination is shown in the flow diagram of FIG. 9. At step 900 of FIG. 9, the processor determines whether the barrier distance is greater than the safe space headway indicating that the current speed of the virtual probe and the distance from the virtual probe to the next barrier is such that the velocity of the virtual probe could be increased if desired. If the barrier distance is greater than the safe space headway, the processor determines whether the virtual probe is traveling at a selected maximum speed at step 902. The selected maximum speed may be the speed limit of the roadway or some slower speed that is selected to evaluate traffic parameters such as travel time for slower drivers. If the virtual probe is not traveling at the maximum speed, the virtual probe is accelerated at step 904. If the virtual probe is traveling at the maximum speed, the speed of the virtual probe is not changed at step 906.

If the barrier distance is not greater than the safe space headway at step 900, step 908 is performed to determine whether the barrier ahead is the queue or is the stop line. If the barrier ahead is the queue at step 908, the speed of the last vehicle in the queue is compared to the speed of the virtual probe at step 910. If the speed of the virtual probe is greater than the speed of the last vehicle in the queue, the virtual probe is decelerated at step 912. If the speed of the virtual probe is the same as the speed of the last vehicle in the queue, the speed of the virtual probe is left unchanged at step 914. If the barrier in front of the virtual probe is not the queue at step 908, the signal status of the control signal is determined at step 916. If the signal status is green at step 916, the speed of the virtual probe is compared to the maximum speed for the virtual probe at step 918. If the speed of the virtual probe is less than the maximum speed at step 918, the virtual probe is accelerated at step 920. If the virtual probe is traveling at the maximum speed at step 918, the speed of the virtual probe is left unchanged at step 921.

If the signal status at step 916 is red, the virtual probe speed is compared to 0 at step 922. If the virtual probe speed is greater than 0, the virtual probe is decelerated at step 924. If the virtual probe speed is equal to 0 at step 922, the virtual probe speed is left unchanged at step 926.

If the signal status at step 916 is yellow, the processor determines whether the virtual probe will be able to cross the stop line in the remaining yellow time $y(\tau)$. In particular, in step 928, the processor determines if:

$$L^P(\tau) < L_y^P(\tau) \quad \text{Eq. 36}$$

where $$L_y^P(\tau) = \begin{cases} u^P(\tau)\cdot y(\tau) + \frac{1}{2}\gamma_a \cdot y^2(\tau) & \text{if } y(\tau) \le y^P(\tau) \\ u^P(\tau)\cdot y^P(\tau) + \frac{1}{2}\gamma_a (y^P(\tau))^2 + u_f(y(\tau) - y^P(\tau)) & \text{otherwise} \end{cases} \quad \text{Eq. 37}$$

where, if equation 36 is true, the virtual probe will be able to cross into the intersection before the end of the yellow time, $\gamma_a$ is a constant acceleration rate and $y^P(\tau)$ is the acceleration time required for the virtual probe to reach the maximum allowed velocity $u_f$ and is computed as:

$$y^P(\tau) = \frac{u_f - u^P(\tau)}{\gamma_a} \quad \text{Eq. 38}$$

If the virtual probe is able to cross over the stop line at step 928, the processor determines whether the virtual probe is going the maximum allowed velocity at step 930. If the probe is not going the maximum allowed velocity at step 930, the virtual probe is accelerated at step 932. If the virtual probe is going the maximum allowed velocity, the virtual probe speed is left unchanged at step 934.

If the virtual probe is not able to cross over the stop line in the time left for the yellow signal at step 928, the virtual probe is decelerated at step 936 so that it may be stopped before the stop line.

After determining whether to change the velocity of the virtual probe at step 414, the processor updates the position and velocity of the probe at step 416. If the probe is to be accelerated, the position and velocity of the probe for the next time interval is calculated as:

$$x^P(\tau + \Delta t) = x^P(\tau) + u^P(\tau)\Delta t + \frac{1}{2}\gamma_a \Delta t^2 \quad \text{Eq. 39}$$

$$u^P(\tau + \Delta t) = u^P(\tau) + \gamma_a \Delta t \quad \text{Eq. 40}$$

where $\Delta t$ is the time difference between the time intervals at which the position and velocity of the virtual probe are updated. Under one embodiment, $\Delta t$ is one second.

If the virtual probe is to be decelerated, the position and velocity for the virtual probe at the next time interval is determined as:

$$x^P(\tau + \Delta t) = x^P(\tau) + u^P(\tau)\Delta t - \frac{1}{2}\gamma_d^P \Delta t^2 \quad \text{Eq. 41}$$

$$u^P(\tau + \Delta t) = u^P(\tau) - \gamma_d^P(\tau)\Delta t \quad \text{Eq. 42}$$

$$\gamma_d^P(\tau) = \begin{cases} \frac{(u^P(\tau))^2}{2L^P(\tau)} & \text{if } L_q(\tau) = 0 \\ \frac{(u^P(\tau) - u_q(\tau))^2}{2L^P(\tau)} & \text{otherwise} \end{cases} \quad \text{Eq. 43}$$

If there is no speed change for the virtual probe, the position and velocity for the virtual probe for the next time interval is computed as:

$$x^P(\tau+\Delta t) = x^P(\tau) + u^P(\tau)\Delta t \quad \text{Eq. 44}$$

$$u^P(\tau+\Delta t) = u^P(\tau) \quad \text{Eq. 45}$$

After the position and velocity of the virtual probe have been updated, the new position of the probe is compared to the stop line at step 418. If the new position of the probe is not past the stop line at step 418, $\tau$ is set equal to $\tau+\Delta t$ step 420 and the process returns to step 408 to re-compute the length of the queue and the speed of the last vehicle in front of the probe in the queue. Steps 410, 412, 414, 416 and 418 are then repeated. When the virtual probe is past the stop line at step 418, the time $\tau+\Delta t$ is stored at step 422.

Figure 10:
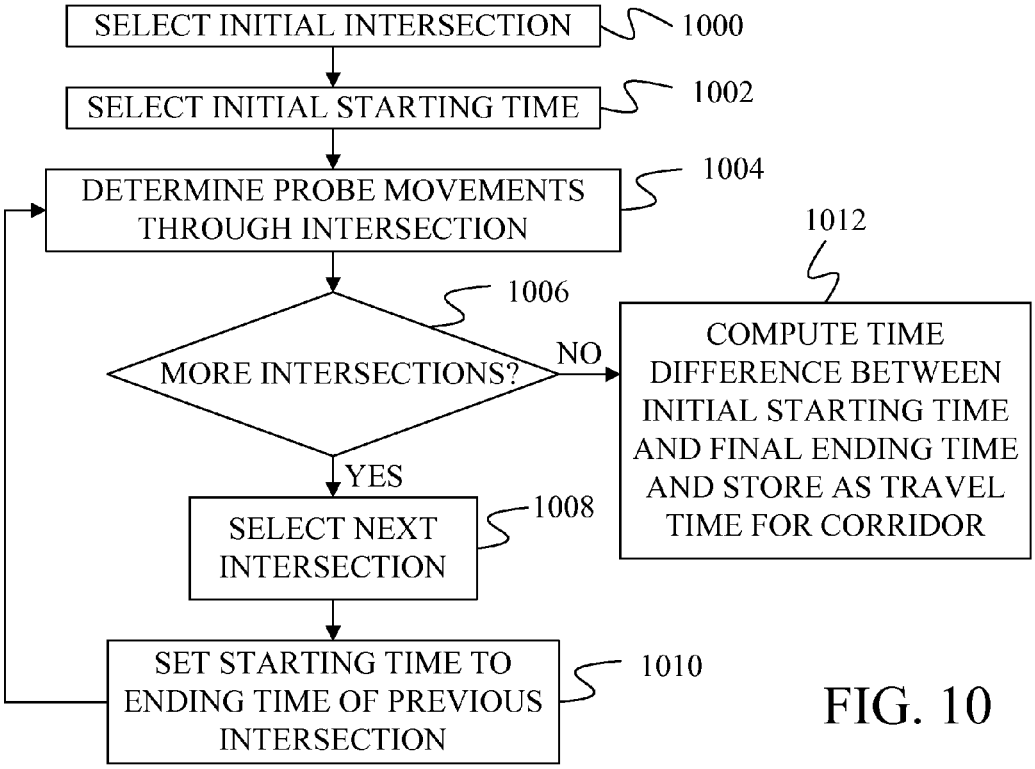
FIG. 10 is a flow diagram for estimating travel time along a corridor using sequential intersection traversal.

FIG. 10 provides a flow diagram of a method that computes the travel time across a corridor comprising multiple intersections by sequentially determining the travel time across each intersection.

In step 1000, an initial intersection is selected and at step 1002, an initial starting time is selected. At step 1004, the method discussed in the flow diagram of FIG. 4 is used to determine virtual probe movements through the selected intersection. At step 1006, the processor determines if there are more intersections along the corridor. If there are more intersections, the next intersection in the corridor is selected at step 1008. The starting position for the next intersection is taken as the ending position from the current intersection. At step 1010, the starting time for the next intersection is set to the ending time of the previous intersection. As such, the two time periods for the two intersections do not overlap. Instead, the time period for one intersection ends before the time period for the next intersection begins.

After step 1010, the process returns to step 1004 to determine the virtual probe's movements through the new intersection. Steps 1004, 1006, 1008 and 1010 are then repeated until there are no more intersections at step 1006. When there are no more intersections along the corridor, the time difference between the initial start time selected at step 1002 and the final ending time determined for the last intersection is computed and stored as the travel time for the corridor at step 1012.

Under one embodiment, the process of FIG. 10 is repeated by selecting a different initial intersection in step 1000 while using the same initial starting time. This produces a separate travel time through the corridor beginning from each intersection along the corridor.

Figure 11:
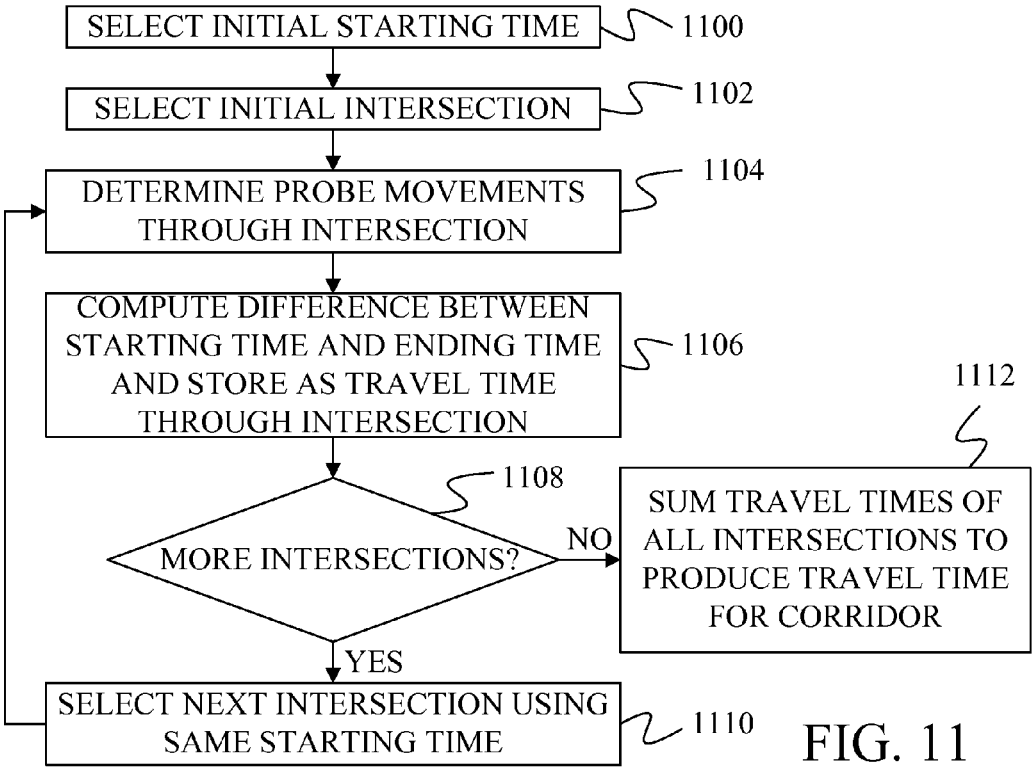
FIG. 11 is a flow diagram for estimating travel time along a corridor using simultaneous intersection traversal.

FIG. 11 provides a flow diagram of an alternative technique for determining the travel time through a corridor of multiple intersections.

At step 1100, an initial starting time is selected and at step 1102, an intersection is selected. In step 1104, probe movements through the selected intersection are determined using the flow diagram of FIG. 4. At step 1106, the difference between the starting time and the ending time found through the flow diagram of FIG. 4 is stored as the travel time through the intersection. At step 1108, the process determines if there are more intersections in the corridor. If there are more intersections, the next intersection is then selected at step 1110 using the same initial starting time. Since the same initial starting time is used for each intersection in the corridor, the travel times for the intersections represent overlapping time ranges. After the next intersection is selected and the same initial starting time is selected, the process returns to step 1104 and step 1104 and 1106 are repeated for the new intersection. When there are no more intersections at step 1108, the travel times through all the intersections are summed to produce a travel time through the corridor at step 1112.

In the discussion above, travel times through intersections and corridors have been discussed. However, the techniques described may also be used to determine other travel parameters such as the number of stops made by the probe in traveling along the corridor, the total delay of traffic along the corridor, and the average delay along the corridor. The total delay of traffic at any one intersection is equal to the sum of the amount of time each vehicle in a queue spends in the queue. The average delay is the total delay divided by the number of vehicles in the queue. The total delay for an intersection may be determined by integrating the position of the back of the queue over time.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method comprising:

retrieving vehicle detector data and traffic control signal data for a signalized intersection, the vehicle detector data detecting the passing of at least one vehicle;

assigning an initial position for a virtual probe that does not correspond to any vehicle on a roadway; and a processor updating a position and a velocity for the virtual probe such that the position and velocity of the virtual probe is determined multiple times from a time when the virtual probe is at the initial position until a time when the updated position of the virtual probe is past a stop line of the intersection.

2. The method of claim 1 further comprising the processor computing the time required for the virtual probe to travel from the initial position to the position past the intersection.

3. The method of claim 1 further comprising:

retrieving vehicle detection data and traffic control signal data for multiple intersections;

updating a position and a velocity for the virtual probe such that the position and velocity of the virtual probe is determined multiple times from a time when the virtual probe is at the initial position until a time when the updated position of the virtual probe is past a stop line of a last intersection of the multiple intersections.

4. The method of claim 3 further comprising the processor computing the time required for the virtual probe to travel from the initial position to the position past the last intersection.

5. The method of claim 3 further comprising:

for each intersection in the multiple intersections:

selecting a respective initial position for the virtual probe; and updating a position and a velocity for the virtual probe at such that the position and velocity of the virtual probe is determined multiple times from a time when the virtual probe is at the respective initial position for the intersection until a time when the updated position of the virtual probe is past a stop line of a last intersection of the multiple intersections.

6. The method of claim 5 further comprising the processor computing a separate travel time for each intersection, where each travel time comprises the time required for virtual probe to travel from the respective initial position of the intersection to the position past the stop line of the last intersection.

7. The method of claim 1 further comprising:

retrieving vehicle detection data and traffic control signal data for multiple intersections;

assigning an initial position for a virtual probe for each intersection; and a processor updating a position and a velocity for each virtual probe such that the position and velocity of each virtual probe is determined multiple times during a respective intersection travel time interval from a time when the respective virtual probe is at its respective initial position until a time when the updated position of the respective virtual probe is past a stop line for its respective intersection, and such that intersection travel time intervals of the multiple intersections overlap each other.

8. The method of claim 7 further comprising the processor summing the respective intersection travel time intervals to provide a time of travel for traveling through the multiple intersections.

9. The method of claim 1 wherein updating the position and the velocity of the virtual probe comprises:

determining a distance from the virtual probe to the closer of a vehicle in front of the virtual probe and a stop line at the intersection;

determining a safe space needed between the virtual probe and one of the vehicle in front of the virtual probe and the stop line;

the processor using the distance, safe space, and a current velocity for the virtual probe to determine whether to change the velocity of the virtual probe.

10. The method of claim 9 wherein determining the distance between the virtual probe and the vehicle in front of the virtual probe comprises determining a distance from the stop line of the intersection to the vehicle in front of the virtual probe.

11. The method of claim 10 wherein determining the distance from the stop line of the intersection to the vehicle in front of the virtual probe comprises determining the number of vehicles between the virtual probe and the stop line.

12. The method of claim 11 wherein the vehicle detector data comprises data from a detector that senses vehicles that pass through a sensing area of the detector.

13. The method of claim 12 wherein determining the distance from the stop line of the intersection to the vehicle in front of the virtual probe comprises determining a distance that is farther than the distance from the stop line to the sensing area of the detector and wherein determining the distance comprises determining that the vehicle in front of the virtual probe stopped before the sensing area of the detector.

14. The method of claim 13 wherein determining the distance from the stop line of the intersection to the vehicle in front of the virtual probe comprises:

determining a queue length representing a distance from the stop line to a last vehicle stopped in a queue at the intersection;

determining a time at which the last vehicle stopped in the queue at the intersection began to move after being stopped in the queue;

using the queue length and the time at which the last vehicle began to move to determine a rate of growth of the queue; and using the rate of growth of the queue to determine the distance from the stop line of the intersection to the vehicle in front of the virtual probe.

15. The method of claim 14 wherein determining the queue length comprises:

receiving a time at which the signal at the intersection changes from red to green;

determining a time at which a vehicle stopped at the sensing area of the detector begins to move;

using the time at which the signal at the intersection changed from red to green, the time at which a vehicle stopped at the sensing area of the detector begins to move, and a distance from the stop line to the sensing area of the detector to determine a velocity of a discharge shockwave;

determining a flow rate and a vehicle density for vehicles being discharged at a saturation rate across the sensing area of the detector;

determining a flow rate and a vehicle density for vehicles arriving at the sensing area of the detector at an arrival rate;

using the flow rate and vehicle density for vehicles being discharged at the saturation rate and the flow rate and vehicle density for vehicles arriving at the sensing area of the detector at the arrival rate to determine a velocity for a departure shockwave; and using the velocity of the discharge shockwave and the velocity of the departure shockwave to determine the queue length.

16. The method of claim 15 wherein determining the time at which the last vehicle stopped in the queue at the intersection began to move after being stopped in the queue comprises using the queue length and the discharge velocity to determine the time.

17. A computer-readable medium having computer-executable instructions that cause a processor to perform steps comprising:

retrieving stored signal data and vehicle detector data for a signalized intersection;

determining a position and velocity for a virtual probe that is not physically on the roadways;

determining a separation distance from the virtual probe to a vehicle in front of the virtual probe based on the signal data and vehicle detector data;

determining a safe space needed between the virtual probe and the vehicle in front of the virtual probe;

using the separation distance, the safe space, the position of the virtual probe and the velocity of the virtual probe to determine whether to change the velocity of the virtual probe; and using the position, the velocity and any change in velocity of the virtual probe to determine a new position and new velocity for the virtual probe.

18. The computer-readable medium of claim 17 wherein the steps of determining a separation distance, determining a safe space, determining whether to change the velocity of the virtual probe and determining a new position and new velocity for the virtual probe are repeated multiple times before the position of the virtual probe passes the stop line.

19. The computer-readable medium of claim 17 having computer-executable instructions that cause a processor to perform further steps comprising:

retrieving stored signal data and vehicle detector data for multiple intersections;

for each intersection of the multiple intersections determining a first position and velocity for the virtual probe and performing the steps of determining a separation distance, determining a safe space, determining whether to change the velocity of the virtual probe and determining a new position and new velocity for the virtual probe multiple times before the position of the virtual probe passes the stop line of the respective intersection.

20. The computer-readable medium of claim 19 wherein the stored signal data and vehicle detector data comprises data for a range of times for each intersection and wherein the steps of determining a separation distance, determining a safe space, determining whether to change the velocity of the virtual probe and determining a new position and new velocity for the virtual probe multiple times before the position of the virtual probe passes the stop line of the respective intersection are performed for different ranges of time for different intersections.

21. The computer-readable medium of claim 20 having computer-executable instructions that cause a processor to perform further steps comprising:

for each intersection, determining an amount of time required for the virtual probe to travel from the first position for the intersection through a stop line of the intersection to produce a travel time for the intersection; and summing the travel times for the intersections to produce a travel time for a corridor.

22. The computer-readable medium of claim 19 wherein the stored signal data and vehicle detector data comprises data for a range of times for each intersection and wherein the steps of determining a separation distance, determining a safe space, determining whether to change the velocity of the virtual probe and determining a new position and new velocity for the virtual probe multiple times before the position of the virtual probe passes the stop line of the respective intersection are performed for overlapping ranges of time for different intersections.

23. The computer-readable medium of claim 22 having computer-executable instructions that cause a processor to perform further steps comprising:

for each intersection, determining an amount of time required for the virtual probe to travel from the first position for the intersection through a stop line of the intersection to produce a travel time for the intersection; and summing the travel times for the intersections to produce a travel time for a corridor.

24. The computer-readable medium of claim 17 wherein the vehicle detector data comprises data from a detector that detects vehicles at a sensing position.

25. The computer-readable medium of claim 24 having computer-executable instructions that cause a processor to perform further steps comprising determining that the vehicle in front of the virtual probe is stopped at a position before the sensing position of the detector.

26. The computer-readable medium of claim 25 having computer-executable instructions that cause a processor to perform further steps comprising determining the distance from the stop line of the intersection to the vehicle in front of the virtual probe by:

determining a queue length representing a distance from the stop line to a last vehicle stopped in a queue at the intersection;

determining a time at which the last vehicle stopped in the queue at the intersection began to move after being stopped in the queue;

using the queue length and the time at which the last vehicle began to move to determine a rate of growth of the queue; and using the rate of growth of the queue to determine the distance from the stop line of the intersection to the vehicle in front of the virtual probe.

27. The computer-readable medium of claim 26 wherein determining the queue length comprises:

receiving a time at which the signal at the intersection changes from red to green;

determining a time at which a vehicle stopped at the sensing position of the detector begins to move;

using the time at which the signal at the intersection changed from red to green, and the time at which a vehicle stopped at the sensing position of the detector begins to move to determine a velocity of a discharge shockwave;

determining a flow rate and a vehicle density for vehicles being discharged in a saturation state across the sensing position of the detector;

determining a flow rate and a vehicle density for vehicles arriving at the sensing position of the detector in an arrival state;

using the flow rate and vehicle density for vehicles being discharged in the saturation state and the flow rate and vehicle density for vehicles arriving at the sensing position of the detector in the arrival state to determine a velocity for a departure shockwave; and using the velocity of the discharge shockwave and the velocity of the departure shockwave to determine the queue length.

28. The computer-readable medium of claim 27 wherein determining the time at which the last vehicle stopped in the queue at the intersection began to move after being stopped in the queue comprises using the queue length and the discharge velocity to determine the time.

29. A method comprising:

a processor determining a velocity of a discharge shockwave that starts at an intersection stop line and passes through a queue of vehicles located before the stop line;

a processor determining a velocity of a departure shockwave that moves from the end of the queue toward the stop line;

a processor using the velocity of the discharge shockwave and the velocity of the departure shockwave to determine a length of the queue of vehicles.

30. The method of claim 29 wherein determining the velocity of the discharge shockwave comprises:

receiving a time at which a signal at the intersection changes from red to green;

determining a time at which a vehicle stopped at a sensing position of a detector begins to move; and using the time at which the signal at the intersection changed from red to green, and the time at which a vehicle stopped at the sensing position of the detector begins to move to determine the velocity of the discharge shockwave.

31. The method of claim 29 wherein determining the velocity of the departure shockwave comprises:

determining a flow rate and a vehicle density for vehicles being discharged in a saturation state across a sensing position of a detector;

determining a flow rate and a vehicle density for vehicles arriving at the sensing position of the detector in an arrival state; and using the flow rate and vehicle density for vehicles being discharged in the saturation state and the flow rate and vehicle density for vehicles arriving at the sensing position of the detector in the arrival state to determine a velocity for a departure shockwave.

32. The method of claim 31 further comprising determining a time point where the vehicles change from the saturation state to the arrival state based on a time interval between vehicles passing over the sensing position of the detector.

33. The method of claim 29 further comprising determining a time at which the queue of vehicles reaches a maximum length.

34. The method of claim 33 wherein determining a time at which the queue of vehicles reaches a maximum length comprises using a time at which a vehicle stopped at the sensing position of the detector begins to move, the distance from the stop line to the sensing position of the detector, the length of the queue and the velocity of the discharge shockwave to determine the time at which the queue of vehicles reaches a maximum length.

35. A traffic monitoring system comprising:

a vehicle detector sensor that senses a signal produced by a vehicle detector that generates the signal based on vehicles passing a detecting position located before an intersection;

a signal state sensor that senses the state of a signal at the intersection;

a storage unit that stores data corresponding to the signal of the vehicle detector and states of the signal sensed by the signal state sensor;

a processor that receives data stored in the storage unit and that uses the received data to compute a length of a queue of vehicles at the intersection through steps comprising:

determining the velocities of two shockwaves, each shockwave representing the motion of a discontinuity in a concentration of vehicles along a roadway leading to the intersection; and using the velocities of the two shockwaves to determine the length of the queue of vehicles.

36. The traffic monitoring system of claim 35 wherein a distance from the detecting position to the stop line is shorter than the length of the queue of vehicles.

37. The traffic monitoring system of claim 35 wherein determining the velocities of two shockwaves comprises determining the velocity of a first shockwave representing the motion of a discontinuity away from the stop line and determining the velocity of a second shockwave representing the motion of a discontinuity toward the stop line.

38. The traffic monitoring system of claim 37 wherein determining the velocity of the first shockwave comprises:

determining a time when the signal state changes from red to green;

determining a time when a vehicle that is stopped before the detecting position moves into the detecting position based on the signal from the vehicle detector sensor; and using the time when the signal state changes from red to green, the time when a vehicle that is stopped before the detecting position moves into the detecting position, and the distance from the detecting position to the stop line to determine the velocity of the first shockwave.

39. The traffic monitoring system of claim 37 wherein determining the velocity of the second shockwave comprises:

determining a time point at which the rate of flow at the detecting position changed by comparing intervals between vehicles to a threshold interval;

determining the rate of flow and density of vehicles at the detecting position before the time point at which the rate of flow changed;

determining the rate of flow and density of vehicles at the detecting position after the time point at which the rate of flow changed; and using the rate of flow and density of vehicles at the detecting position before the time point at which the rate of flow changed and the rate of flow and density of vehicles at the detecting position after the time point at which the rate of flow changed to determine the velocity of the second shockwave.

40. The traffic monitoring system of claim 35 wherein the processor further computes a time at which a maximum queue length was present at the intersection.

41. A method comprising:

receiving a signal that indicates that a traffic control signal turned red;

receiving a sensor signal that indicates when vehicles pass over a sensor;

counting a number of vehicles that pass over the sensor during a period of time that begins when the traffic control signal turns red and ends when a last vehicle in a queue passes over the sensor; and using a distance from the sensor to a stop line, the number of vehicles, and a vehicle density value to compute a distance from the stop line to the end of the queue.

* * * * *